US011149762B2

(12) United States Patent
Huang

(10) Patent No.: US 11,149,762 B2
(45) Date of Patent: Oct. 19, 2021

(54) PISTONLESS DOUBLE-ACTING CYLINDER APPARATUS CROSS-REFERENCE TO RELATED APPLICATIONS

(71) Applicant: Chaoneng Huang, Foshan (CN)

(72) Inventor: Chaoneng Huang, Foshan (CN)

( * ) Notice: Subject to any disclaimer, the term of this patent is extended or adjusted under 35 U.S.C. 154(b) by 0 days.

(21) Appl. No.: 17/037,611

(22) Filed: Sep. 29, 2020

(65) Prior Publication Data

US 2021/0010492 A1 Jan. 14, 2021

Related U.S. Application Data

(63) Continuation of application No. PCT/CN2019/111784, filed on Oct. 18, 2019.

(30) Foreign Application Priority Data

Oct. 21, 2018 (CN) ..... 201811225602.1

(51) Int. Cl.
*F15B 15/14* (2006.01)
*F15B 15/22* (2006.01)

(52) U.S. Cl.
CPC ..... *F15B 15/1428* (2013.01); *F15B 15/1447* (2013.01); *F15B 15/1461* (2013.01); (Continued)

(58) Field of Classification Search
CPC .... B62D 5/12; B62D 5/20; B62D 5/22; F15B 15/1438; F15B 15/1442; F15B 15/1447; F15B 15/1457
See application file for complete search history.

(56) References Cited

U.S. PATENT DOCUMENTS 2,997,026 A * 8/1961 Zimmerermarke ..... F15B 15/1447 92/128
RE27,204 E * 10/1971 McCreery ..... F15B 15/149 92/117 R (Continued)

FOREIGN PATENT DOCUMENTS

CN 201891691 U 7/2011
CN 204371820 U 6/2015

(Continued)

OTHER PUBLICATIONS

Internation Search Report of PCT/CN2019/111784, dated Jan. 16, 2020.

*Primary Examiner* — Michael Leslie
*Assistant Examiner* — Matthew Wiblin

(57) ABSTRACT

A pistonless double-acting cylinder apparatus comprises a piston rod member, a first cylinder member disposed on the piston rod member, a second cylinder member disposed on an end surface of the first cylinder member, a tie rod which connects the first cylinder member and the second cylinder member, nuts provided on both ends of the tie rod, a first sealing ring located between the first cylinder member and the second cylinder member, a first cushion and a second cushion disposed on the piston rod member. The piston rod member comprises a piston rod left section, a first sealing gasket disposed on the piston rod left section, a piston rod middle section disposed on an end surface of the first sealing gasket, a second sealing gasket disposed on an end surface of the piston rod middle section, a piston rod right section disposed on the second sealing gasket.

5 Claims, 2 Drawing Sheets

(52) U.S. Cl.
CPC ..... *F15B 15/1438* (2013.01); *F15B 15/1442* (2013.01); *F15B 15/1457* (2013.01); *F15B 15/226* (2013.01); *F15B 2211/7053* (2013.01)

(56) References Cited

U.S. PATENT DOCUMENTS

| | | | | | |
|---|---|---|---|---|---|
| 4,887,683 | A * | 12/1989 | Klosterhaus | B62D 3/12 | 180/428 |
| 4,953,653 | A * | 9/1990 | Klosterhaus | B62D 5/22 | 180/428 |
| 4,986,382 | A * | 1/1991 | Harrison | B62D 5/10 | 180/428 |
| 5,251,717 | A * | 10/1993 | Klosterhaus | B62D 5/22 | 180/428 |
| 9,573,333 | B2 | 2/2017 | Lee | | |
| 2002/0061251 | A1 | 5/2002 | McCabe | | |
| 2005/0103559 | A1 * | 5/2005 | Sikora | F15B 18/00 | 180/403 |
| 2008/0250767 | A1 | 10/2008 | Boyko | | |
| 2013/0019980 | A1 * | 1/2013 | Baugh | F15B 1/24 | 138/31 |
| 2014/0165963 | A1 * | 6/2014 | Langham | F01L 9/10 | 123/350 |
| 2017/0203787 | A1 * | 7/2017 | Nelson | B62D 6/00 | |

FOREIGN PATENT DOCUMENTS

| | | | | |
|---|---|---|---|---|
| CN | 105422547 | A | 3/2016 | |
| CN | 206708127 | U | 12/2017 | |
| CN | 109162982 | A | 1/2019 | |
| GB | 2041105 | A * | 9/1980 | B62D 5/22 |
| WO | 2015013181 | A1 | 1/2015 | |

* cited by examiner

PISTONLESS DOUBLE-ACTING CYLINDER APPARATUS CROSS-REFERENCE TO RELATED APPLICATIONS

CROSS-REFERENCE TO RELATED APPLICATIONS

This application is a continuation of and claims priority to International (PCT) Patent Application No. PCT/CN2019/111784, filed on Oct. 18, 2019, entitled "Pistonless Double-Acting Cylinder Apparatus," which claims the priority of Chinses Patent Application No. 201811225602.1 filed Oct. 21, 2018. These contents of the applications are hereby incorporated by reference.

TECHNICAL FIELD

The present disclosure relates to the field of cylinder movement without electric action, in particular to a pistonless double-acting cylinder apparatus.

BACKGROUND

In the process of industrial upgrading, the machine is developed in a direction to be larger and or microscopic. The machine upgrade requires a corresponding upgrade of the parts that make up the machine. It is necessary to continuously improve the manufacturing process of the parts and add the basic functions of the parts. In the industrial automation production, in the era of artificial intelligence, it is usually difficult to make traditional accessories and devices difficult to be particularly small or particularly large. That is mainly due to the limits of existing processing and manufacturing equipment and related processes. The existing cylinder apparatus mainly uses a piston with a sealing ring to divide the inner cavity of the cylinder into two closed cavities. The pressure difference between the two cavities pushes the piston. In this case, it is a high cost to make an extreme small piston or inner cavity of the cylinder. It is also a high cost to make a large and long piston or inner cavity of the cylinder. The single-acting cylinder apparatus is only single-acting, which has great application limitations. There is performance degradation of the automatic reset device comes along the longer cylinder apparatus.

SUMMARY OF THIS DISCLOSURE

One object of the present disclosure is create a new cylinder apparatus in the automatization filed, for facilitating the miniaturization of the cylinder apparatus or allowing the production of a larger and longer cylinder, and the piston rod is able to move back and forth in both directions. Accordingly, a pistonless double-acting cylinder apparatus is provided.

To achieve the above object, the present disclosure provides a pistonless double-acting cylinder apparatus. The pistonless double-acting cylinder apparatus comprises a piston rod member, a first cylinder member disposed on the piston rod member, a second cylinder member disposed on an end surface of the first cylinder member, a tie rod which connects the first cylinder member and the second cylinder member, nuts provided on both ends of the tie rod, a first sealing ring located between the first cylinder member and the second cylinder member, a first cushion and a second cushion disposed on the piston rod member; the piston rod member comprises a piston rod left section, a first sealing gasket disposed on the piston rod left section, a piston rod middle section disposed on an end surface of the first sealing gasket, a second sealing gasket disposed on an end surface of the piston rod middle section, a piston rod right section disposed on the second sealing gasket; the first cylinder member comprises a first outer end cover; a first dust-proof ring, a first guide ring, and a second sealing ring disposed within the first outer end cover; a first cylinder disposed on an end surface of the first outer end over; a third sealing ring disposed on an end surface of the first cylinder; a first inner end cover disposed on the third sealing ring; the first inner end cover comprises a first air hole; the second cylinder member comprises a second outer end cover; a second dust-proof ring, a second guide ring, a fourth sealing ring disposed within the second outer end cover; a second cylinder disposed on an end surface of the second outer end cover; a fifth sealing ring disposed on an end surface of the second cylinder; a second inner end cover disposed on the fifth sealing ring; the second inner end cover comprises a second air hole.

In some embodiments, the piston rod member is consisted of the piston rod left section, the piston rod middle section and the piston rod right section. The piston rod left section and the piston rod right section both have a larger diameter, while the piston rod middle section has a smaller diameter.

In some embodiments, the first sealing ring is in close contact with the piston rod middle section, the first inner end cover and the second inner end cover.

In some embodiments, an inner cavity, having the first air hole, is relatively sealed, and is formed by the first cylinder member, the piston rod left section, the piston rod right section and the first sealing ring.

In some embodiments, an inner cavity, having the second air hole, is relatively sealed, and s formed by the second cylinder member, the piston rod right section, the piston rod middle section and the first sealing ring.

In some embodiments, the piston rod member at least comprises one sealing gasket.

The beneficial effect of the present disclosure is as follows.

The present disclosure is a pistonless double-acting cylinder apparatus, which avoids the need to process the inner wall of the cylinder cavity of the cylinder apparatus, and only needs to process both ends of the first cylinder and the second cylinder. The processing is simple and convenient, and the manufacturing process is not limited by the length of the cylinder body and the diameter of the inner cavity. The cylinder body can be made very long, large or very small. The cylinder apparatus realizes two-way action under the action of the medium, which requires a spring to be used in one of the acting directions of the single-acting cylinder apparatus.

The present disclosure is a pistonless double-acting cylinder apparatus. Because there is no piston, the sealing members are all on the end of the cylinder, which is convenient to install and maintain. The double-acting cylinder apparatus is convenient to install and maintain because of the double-acting. Because of the double-acting, the pistonless cylinder has complete functions and can be applied to more occasions.

DETAILED DESCRIPTION OF THE DISCLOSURE

Figure 1:
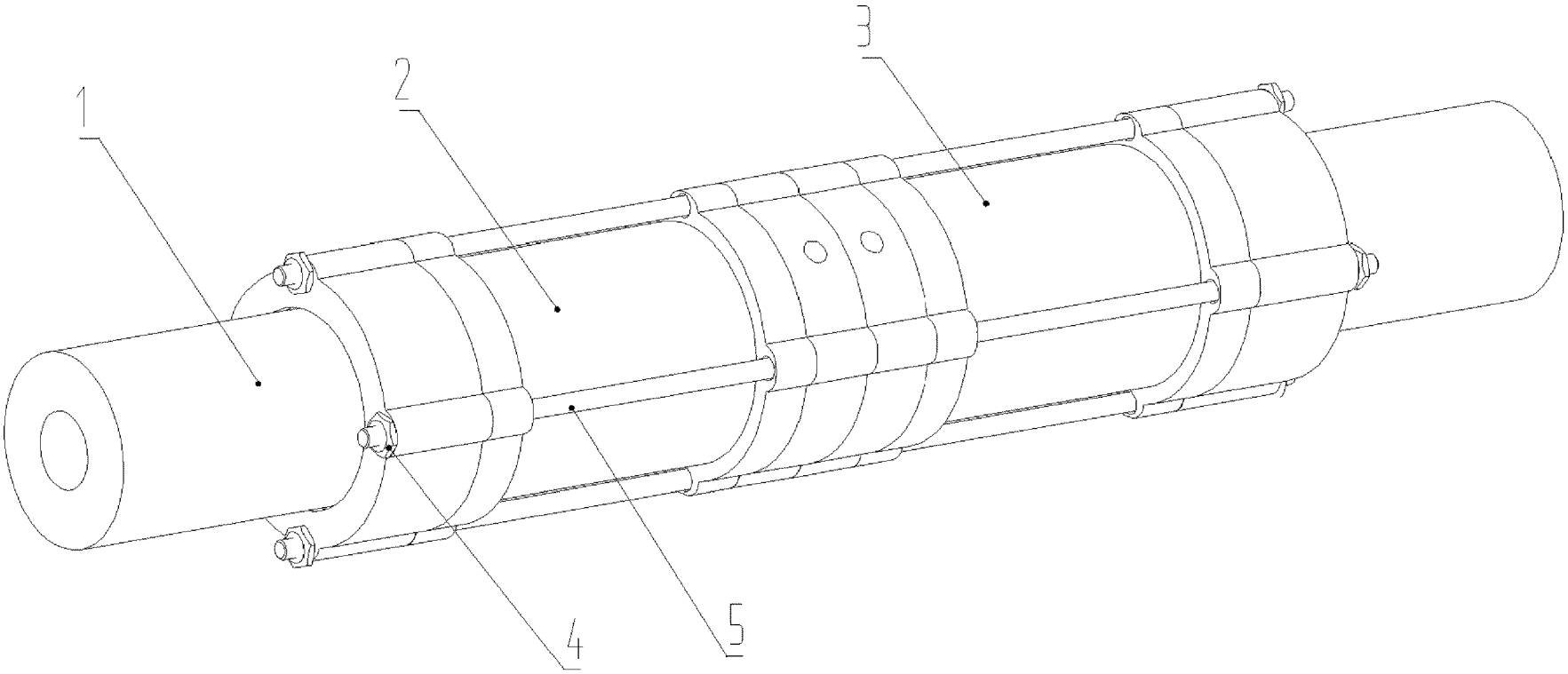
FIG. 1 is a schematic diagram of a pistonless double-acting cylinder apparatus.

The mechanism and working principle of the present disclosure will be described in detail below with reference to the drawings. In order to illustrate this embodiment, some components in the drawings may be omitted, enlarged or reduced, which do not represent the size of the actual product. For those skilled in the art, it is understood that some well-known structures in the drawings and their descriptions may be omitted. It can be understood that the same or similar reference numerals correspond to the same or similar components.

Figure 2:
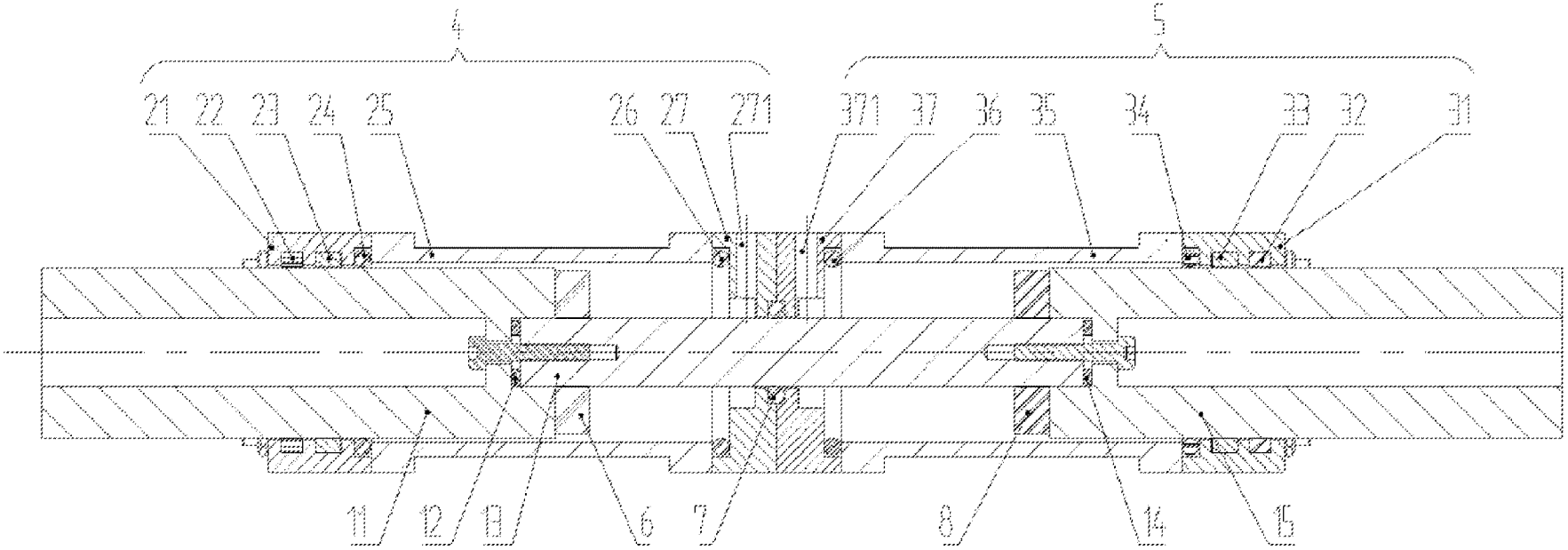
FIG. 2 is a cross-sectional view of the pistonless double-acting cylinder apparatus.

Referred to FIGS. 1-2, the present disclosure provides a pistonless double-acting cylinder apparatus. The pistonless double-acting cylinder apparatus comprises a piston rod member 1, a first cylinder member 2 disposed on the piston rod member 1, a second cylinder member 3 disposed on an end surface of the first cylinder member 2, a tie rod 5 which connects the first cylinder member 2 and the second cylinder member 3, nuts 4 provided on both ends of the tie rod 5, a first sealing ring 7 located between the first cylinder member 2 and the second cylinder member 3, a first cushion 6 and a second cushion 8 disposed on the piston rod member 1; the piston rod member 1 comprises a piston rod left section 11, a first sealing gasket 12 disposed on the piston rod left section 11, a piston rod middle section 13 disposed on an end surface of the first sealing gasket 12, a second sealing gasket 14 disposed on an end surface of the piston rod middle section 13, a piston rod right section 15 disposed on the second sealing gasket 14. The first cylinder member 2 comprises a first outer end cover 21; a first dust-proof ring 22, a first guide ring 23, and a second sealing ring 24 disposed within the first outer end cover 21; a first cylinder 25 disposed on an end surface of the first outer end over 21; a third sealing ring 26 disposed on an end surface of the first cylinder 25; a first inner end cover 27 disposed on the third sealing ring 26; the first inner end cover 27 comprises a first air hole 271. The second cylinder member 3 comprises a second outer end cover 31; a second dust-proof ring 32, a second guide ring 33, a fourth sealing ring 34 disposed within the second outer end cover 31; a second cylinder 35 disposed on an end surface of the second outer end cover 31; a fifth sealing ring 36 disposed on an end surface of the second cylinder 35; a second inner end cover 37 disposed on the fifth sealing ring 36. The second inner end cover 37 comprises a second air hole 371.

The piston rod member 1 is consisted of the piston rod left section 11, the piston rod middle section 13 and the piston rod right section 15. The piston rod left section 11 and the piston rod right section 15 both have a larger diameter, while the piston rod middle section 13 has a smaller diameter. In the working process of the cylinder, the section with larger diameter is subjected to greater thrust under the action of a larger pressure medium, and therefore the piston rod is pushed to move.

The first sealing ring 7 is in close contact with the piston rod middle section 13, the first inner end cover 27 and the second inner end cover 37. Accordingly, the inner cavity of the whole cylinder apparatus is divided into two relatively closed cavities.

An inner cavity, having the first air hole 271, is relatively sealed, and is formed by the first cylinder member 2, the piston rod left section 11, the piston rod middle section 13, and the first sealing ring 7. The closed inner cavity is one of the conditions for the piston rod to realize the first action direction.

An inner cavity, having the second air hole 371, is relatively sealed, and s formed by the second cylinder member 3, the piston rod right section 15, the piston rod middle section 13 and the first sealing ring 7. The closed inner cavity is one of the conditions for the piston rod to realize the first action direction.

The piston rod member at least comprises one sealing gasket.

Accordingly, the present disclosure is a pistonless double-acting cylinder apparatus, which avoids the need to process the inner wall of the cylinder cavity of the cylinder apparatus, and only needs to process both ends of the first cylinder and the second cylinder. The processing is simple and convenient, and the manufacturing process is not limited by the length of the cylinder body and the diameter of the inner cavity. The cylinder body can be made very long and large or very small. The cylinder apparatus realizes two-way action under the action of the medium, which requires a spring to be used in one of the acting directions of the single-acting cylinder apparatus.

The present disclosure is a pistonless double-acting cylinder apparatus. Because there is no piston, the sealing members are all on the end of the cylinder, which is convenient to install and maintain. The double-acting cylinder apparatus is convenient to install and maintain because of the double-acting. Because of the double-acting, the pistonless cylinder has complete functions and can be applied to more occasions.

What is claimed is:

1. A pistonless double-acting cylinder apparatus, comprising:

a piston rod member, a first cylinder member disposed on the piston rod member, a second cylinder member disposed on an end surface of the first cylinder member, a tie rod which connects the first cylinder member and the second cylinder member, nuts provided on both ends of the tie rod, a first sealing ring located between the first cylinder member and the second cylinder member, and a first cushion and a second cushion disposed on the piston rod member;

wherein the piston rod member comprises:

a piston rod left section, a first sealing gasket disposed on the piston rod left section, a piston rod middle section disposed on an end surface of the first sealing gasket, a second sealing gasket disposed on an end surface of the piston rod middle section, and a piston rod right section disposed on the second sealing gasket;

wherein the first cylinder member comprises:

a first outer end cover, a first dust-proof ring, a first guide ring, and a second sealing ring disposed within the first outer end cover, a first cylinder disposed on an end surface of the first outer end over, a third sealing ring disposed on an end surface of the first cylinder, and a first inner end cover disposed on the third sealing ring;

wherein the first inner end cover comprises a first air hole;

the second cylinder member comprises:

a second outer end cover;

a second dust-proof ring, a second guide ring, a fourth sealing ring disposed within the second outer end cover, a second cylinder disposed on an end surface of the second outer end cover, a fifth sealing ring disposed on an end surface of the second cylinder, and a second inner end cover disposed on the fifth sealing ring;

wherein the second inner end cover comprises a second air hole.

2. The pistonless double-acting cylinder apparatus of claim 1, wherein the piston rod member is consisted of the piston rod left section, the piston rod middle section and the piston rod right section; the piston rod left section and the piston rod right section both have a larger diameter, while the piston rod middle section has a smaller diameter.

3. The pistonless double-acting cylinder apparatus of claim 1, wherein the first sealing ring is in close contact with the piston rod middle section, the first inner end cover and the second inner end cover.

4. The pistonless double-acting cylinder apparatus of claim 1, wherein an inner cavity, having the first air hole, is relatively sealed, and is formed by the first cylinder member, the piston rod left section, the piston rod right section and the first sealing ring.

5. The pistonless double-acting cylinder apparatus of claim 1, wherein an inner cavity, having the second air hole, is relatively sealed, and is formed by the second cylinder member, the piston rod right section, the piston rod middle section and the first sealing ring.

* * * * *